US005782442A

United States Patent [19]

Kwak et al.

[11] Patent Number: 5,782,442

[45] Date of Patent: Jul. 21, 1998

[54] ICE SCREW WITH FOLDABLE CRANK HANDLE

[75] Inventors: Hong Kyu Kwak; John Bercaw, both of Salt Lake City, Utah

[73] Assignee: Black Diamond Equipment, Ltd., Salt Lake City, Utah

[21] Appl. No.: 792,954

[22] Filed: Jan. 22, 1997

[51] Int. Cl.[6] ..... A47F 5/08

[52] U.S. Cl. ..... 248/231.9; 248/925; 411/400

[58] Field of Search ..... 248/231.9, 231.91, 248/925; 411/400; 30/308.1, 308.3; 7/145

[56] References Cited

U.S. PATENT DOCUMENTS 5,118,061 6/1992 Byrne et al. ..... 248/925 X 5,347,718 9/1994 Turner ..... 30/308.1 X

FOREIGN PATENT DOCUMENTS 9987 4/1912 United Kingdom ..... 7/145

OTHER PUBLICATIONS

Grivel Mont Blanc Since 1818, 1996 issue, pp. 48 & 49.

Trango Extraordinary Climbing Gear, TiScrew, p. 3.

Charlet Moser

*Primary Examiner*—Ramon O. Ramirez

*Attorney, Agent, or Firm*—Thorpe, North & Western, LLP

[57] ABSTRACT

An ice screw includes a hollow tubular shaft with external screw threads formed on the shaft and a hanger attached to the shaft. The hanger has an eye for clipping on a carabiner. A foldable handle is pivotally attached to the hanger to pivot between a crank position and a folded position. In the crank position, the handle extends from the hanger for grasping to rotate and thus rotate the shaft. In the folded position, the handle folds into a recess formed in the hanger. In the crank position, the hanger serves as a lever arm or crank arm for the handle.

11 Claims, 4 Drawing Sheets

ICE SCREW WITH FOLDABLE CRANK HANDLE

BACKGROUND OF THE INVENTION

1. Field of the Invention

The present invention relates to an ice screw for assisting ice climbers by allowing the securing of a carabiner to a body of ice. More particularly, the present invention relates to an ice screw having a foldable crank handle for facilitating screwing the ice screw into the body of ice without adding significant weight to or interfering with the carabiner.

2. Prior Art

Climbing, whether of mountains, rock faces or ice faces, has become increasingly popular in recent years. In many instances, climbing involves negotiating multiple types of terrain—earth, rock and snow and ice.

While these icy conditions stand as an obstacle to the summit for some climbers, others seek out these conditions because of the added difficulty and challenge. An ice climber, like other climbers, requires special equipment. Some of the gear, such as an ice axe and cramptons (special, spiked boot treads), assists the climber in grasping the surface being climbed. Other gear, such as rope, pitons (spikes), and carabiners (fastening rings for holding rope), acts as a safety or back-up system to catch the climber should he lose his grip and fall. It can be appreciated that a climber, suspended hundreds of feet in the air on a slab of ice, has certain expectations and requirements for his climbing equipment. It is critical that the gear be strong enough to hold the weight of the climber; capable of attaching and holding the climbing surface (holding power); light enough to be carried; and quickly and easily utilized. A climber does not want to carry any more equipment than necessary, have equipment that is difficult to use, or have equipment that he is unsure of.

Initially, much of the gear used in winter alpine or ice climbs was the same gear used in rock climbing. For example, rock pitons would be driven into the ice just as they had been driven into cracks in the rock. Some modifications were made to the rock piton to improve performance on the ice, such as the addition of teeth, a U-shaped shaft, and a hollow tube. Hammering these devices into the ice, however, was inherently dangerous as the hammering could shatter the ice and compromise its integrity. A corkscrew type device was developed that could be twisted into the ice without as much danger of fracturing the ice, but it had little shear strength. The most popular design has been the modern, twist-in, tubular design, or ice screw. The twist-in tube does not fracture the ice as much as the hammered-in piton type and has greater strength than the corkscrews.

Typically, an ice screw is a hollow shaft having an external screw thread. One end has sharp teeth for piercing the ice and the other end has a head or rim. A hanger is attached to the shaft and has an opening or eye for clipping on a carabiner. The hanger also has an opening through which the shaft is inserted. This opening usually has two opposing flat surfaces that mate with flat surfaces near the head of the shaft. The mating surfaces force the shaft and hanger to turn together. The climber typically forces the toothed end of the ice screw into the ice and screws the it into the ice using the hanger as a kind of lever arm. Because of the difficulty in twisting the ice screw, climbers often must use an ice tool, such as an axe, as a lever or even a special wrench or ratchet. Using an axe as a lever can be dangerous and special wrenches add undesirable weight to the climb.

Some ice screws have been developed with special ergonomically designed hangers to aid the climber in twisting the ice screw. The twisting motion, however, is sporadic as the climber must continually release and regrasp the hanger to twist in the screw. Having carried the weight of himself and his gear several hundred feet up a shear ice wall, a climber has little strength to spare in fighting with less energy efficient equipment.

Other ice screws have been developed with an additional crank handle. This design allows the climber to continuously turn the ice screw into the ice. The extra crank handle, however, adds undesirable weight to the climb, and may interfere with installation and release of the carabiner from the hanger. Again, a climber does not want to carry unnecessary weight or be forced to worry about extra parts interfering with critical equipment.

Therefore, it would be advantageous to develop a lightweight ice screw capable of continuous turning without adding extra difficulty and danger to the climb by adding weight and parts that may become entangled with the carabiner.

OBJECTS AND SUMMARY OF THE INVENTION

It is an object of the present invention to provide an ice screw device for assisting climbers on a body of ice in securing a carabiner to the ice.

It is another object of the invention to provide such an ice screw device that is lightweight.

It is still another object of the invention to provide such an ice screw device that is capable of being continuously turned.

It is a further object of the invention to provide such an ice screw device that consists of a minimal number of parts which fulfil the objects indicated.

These and other objects and advantages of the invention are realized in an ice screw device having external screw threads formed on a hollow shaft, with teeth formed on one end and a head on the other. The shaft is inserted through an aperture in a hanger which, when rotated, causes the shaft to rotate. An eye is formed in the hanger for clipping on a carabiner. A crank handle is attached to the hanger so that it may be pivoted into a folded position within a recess formed in the hanger. The handle may also be pivoted from the folded position into a crank position extending from the hanger, to enable "cranking" and rotating the shaft into an ice body.

In accordance with one aspect of the invention, the handle includes a pin that is spring biased to index into notches formed in the hanger so that the handle may selectively lock into the crank position or the folded position.

With the handle extended to the crank position, the shaft may be easily rotated and screwed into a body of ice. Once the shaft is in position in the ice, the handle may be moved into the folded position so as to be out of the way. In this manner, the hanger is essentially used as a crank arm for screwing the shaft.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
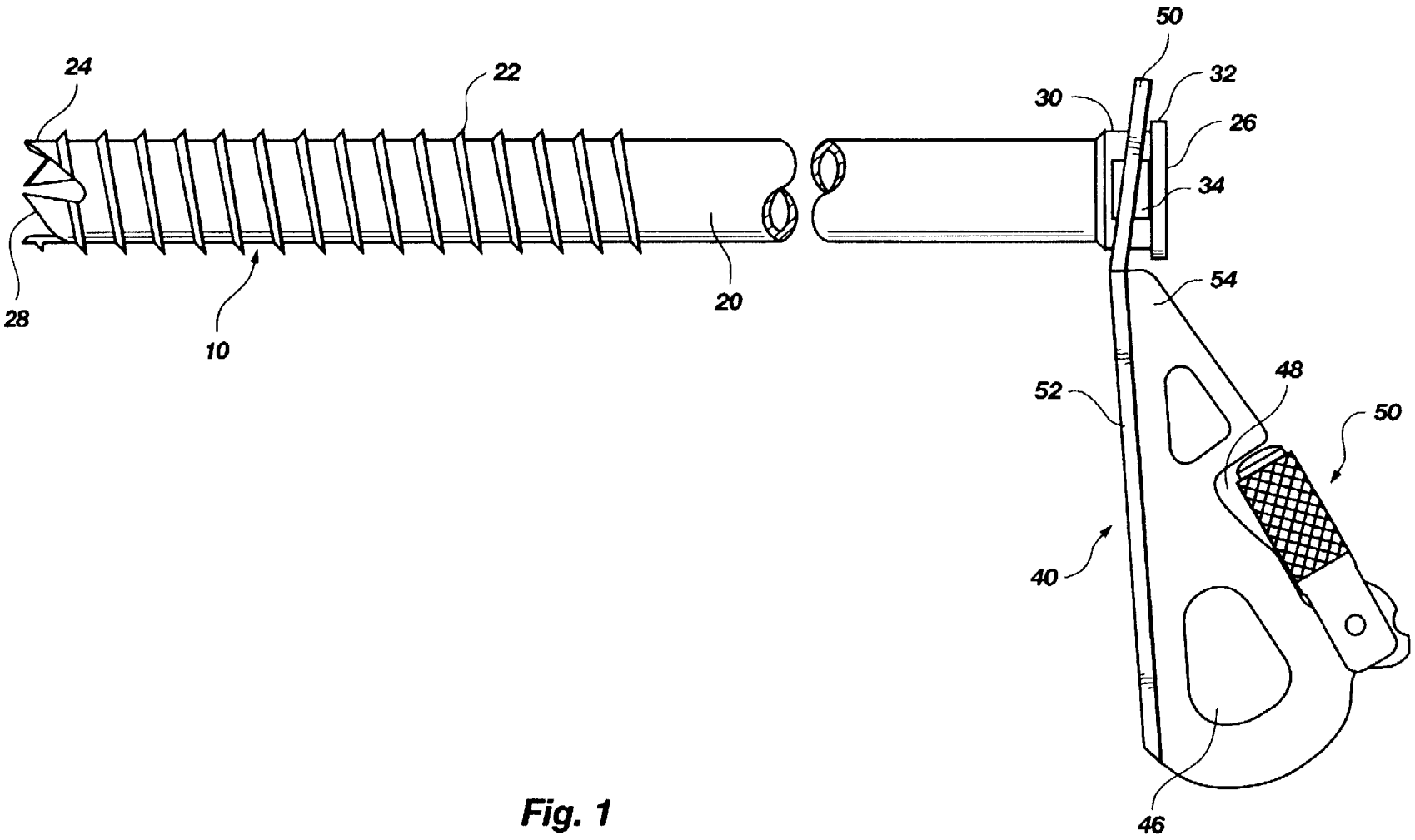
FIG. 1 is a side, elevational, fragmented view of an ice screw incorporating a preferred embodiment of a foldable crank handle of the present invention.

As illustrated in FIG. 1, an ice screw 10 is shown with a foldable crank handle 60 of the present invention. The ice screw 10 has an elongated shaft 20. Preferably, the shaft 20 is a hollow tube. The shaft 20, which has a distal end 24 and a proximal end 26, includes teeth 28 formed at the distal end 24. The teeth 28 penetrate the ice when the shaft 20 is initially inserted into the ice. External screw threads 22 are formed on a portion of the shaft 20, beginning at the distal end 24 and extending along a portion of the shaft 20. The threads 22 preferable extend along one-half to two-thirds of the length of the shaft 20. The shape, pitch, depth, and spacing of the threads 22 may be varied to obtain the best holding power and screwing characteristics.

The shaft 20 also includes a head 30 formed on the proximal end 26. The head 30 preferable has a larger diameter than the diameter of the shaft 20, for example, in the form of a rim 32 with a diameter larger than the diameter of the shaft 20. The head 20 also includes two opposing flat surfaces or flats 34 formed in the curvature of the head 30, the purpose of which is explained below. Alternatively, the head 30 may have a single flat surface, three flat surfaces, etc.

The surface of the shaft 20 preferably is formed with a very smooth, mirror-like surface for facilitating insertion and removal from the ice. Such a surface may be obtained by chemical or electrochemical treatments.

Figure 3:
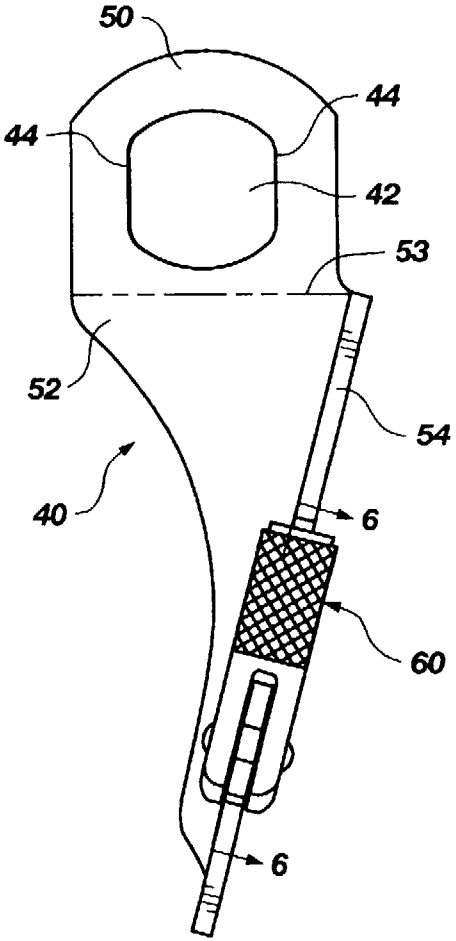
FIG. 3 is a top, plan view of a hanger, unmounted, showing a foldable crank handle in accordance with the present invention.
Figure 2:
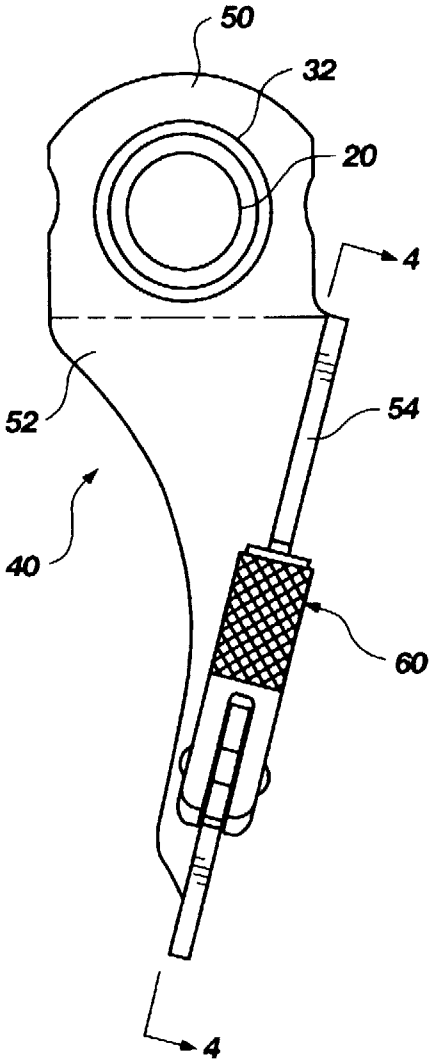
FIG. 2 is a top, plan view of an ice screw incorporating a preferred embodiment of a foldable crank handle of the present invention.

As illustrated in FIGS. 1 and 2, a hanger 40 is attached to the shaft 20. Referring to FIG. 3, the hanger 40 has an aperture 42 through which the shaft 20 is inserted to attach the hanger 40 to the shaft 20. The aperture 42 includes two opposing flat surfaces or flats 44 formed in the curvature of the aperture 44, for mating with the flat surfaces 34 in the head 30 of the shaft 20. Therefore, the shaft 20 and hanger 40 must turn together or, in other words, rotation imparted to the hanger 40 causes the shaft 20 to rotate. Preferably, the diameter of the aperture 42 is greater than the diameter of the shaft 20 or head 30 so that there is play between the hanger 40 and the shaft 20. The diameter of the rim 32 is larger than the diameter of the aperture 42 and prevents the hanger 40 from coming off the shaft 20. The hanger 40 also has an eye 46 (FIG. 1) for clipping on a carabiner (not shown). Also formed in the hanger 40 is a recess 48, the purpose of which is described below.

The hanger 40 is preferable made of a single piece of material bent to form the desired configuration. As illustrated in FIG. 3, the hanger 40 is preferably formed into portions defining three planes. An aperture portion 50 is generally perpendicular to the axis of the shaft 20 and, of course, is the portion of the hanger 40 in which the aperture 42 is formed. A connection portion 52 is nearly coplanar with the aperture portion 50, a slight bend 53 being formed between the two portions 50 and 52 (although the two portions 50 and 52 may be coplanar, or without a bend between them). Because of the play between the hanger 40 and the shaft 20, the angle between the two portions 50 and 52 and the axis of the shaft 20 may vary significantly.

The connection portion 52 connects the aperture portion 50 to a hanger portion 54. The hanger portion 54 is substantially perpendicular to the first two portions 50 and 52. It is of coarse understood that the hanger 40 may be configured in any number of ways.

The hanger 40 is preferable made of sheet steel having sufficient thickness and strength. The general shape of the hanger 40, including the aperture 42, the eye 46, and the recess 48 may be stamped into the steel and then the steel may be bent into its desired configuration.

Figure 5:
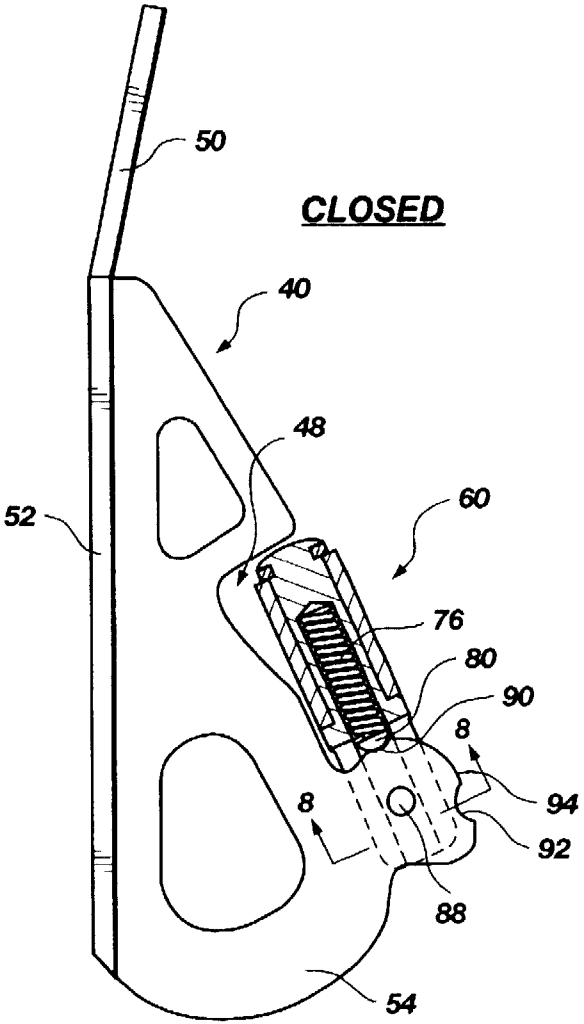
FIG. 5 is a side, elevational, cross-sectional view of a hanger and foldable crank handle of the present invention, shown in the closed position taken along line 4—4 of FIG. 2.
Figure 4:
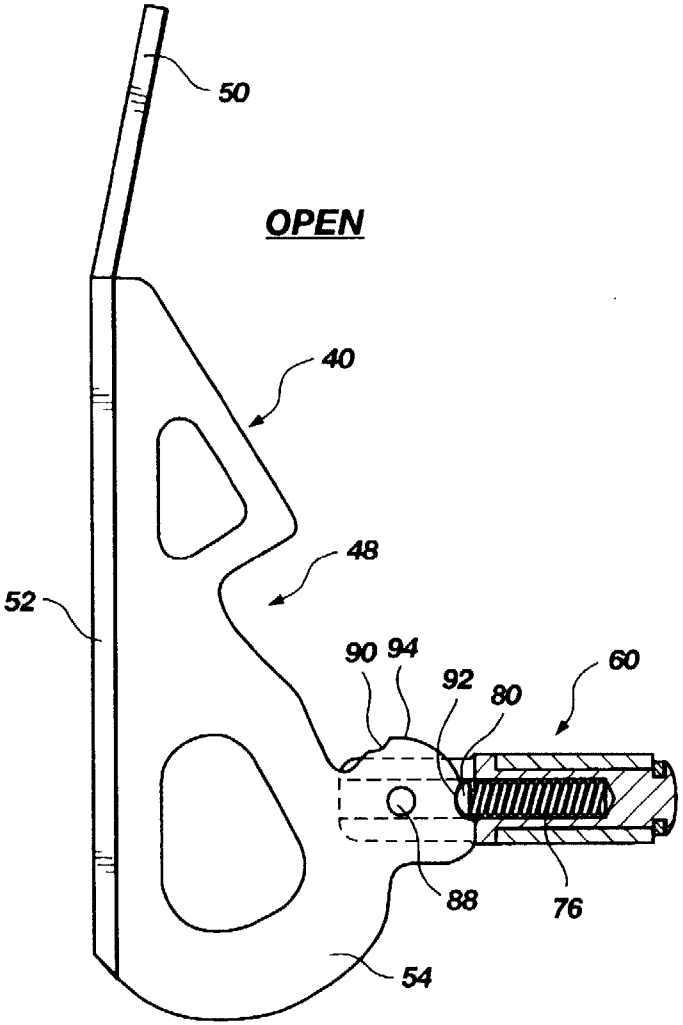
FIG. 4 is a side, elevational, cross-sectional view of a hanger and foldable crank handle of the present invention, shown in the open or "crank" position, taken along line 4—4 of FIG. 2.

As best seen in FIGS. 4 and 5, a handle 60 is pivotally attached to the hanger 40, and may be pivoted to a crank or open position (FIG. 4) and to a folded or closed position (FIG. 5). In the crank position, the handle 60 extends from the hanger 40 for grasping and turning about the axis of the shaft 20. In this manner, the shaft 20 may be screwed into a body of ice.

When in the crank position, the axis of the handle 60 is generally parallel with the axis of the shaft 20, but the angle between them may vary due to the play between the hanger 40 and the shaft 20. In the folded position, the handle 60 is folded into the hanger 40 so that it does not significantly protrude from the hanger to interfere with other climbing gear, as shown in FIG. 5. Preferably, the handle 60 folds into a recess 48 formed in the hanger 40 so that the handle 60 nests within the hanger 40 and does not substantially protrude from the profile of the hanger 40.

Figure 7:
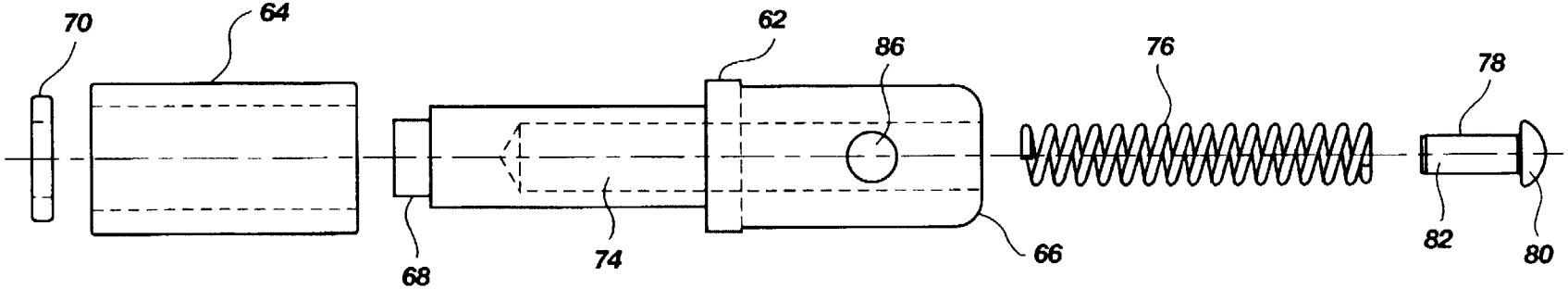
FIG. 7 is an exploded view of a preferred embodiment of a foldable crank handle of the present invention.
Figure 6:
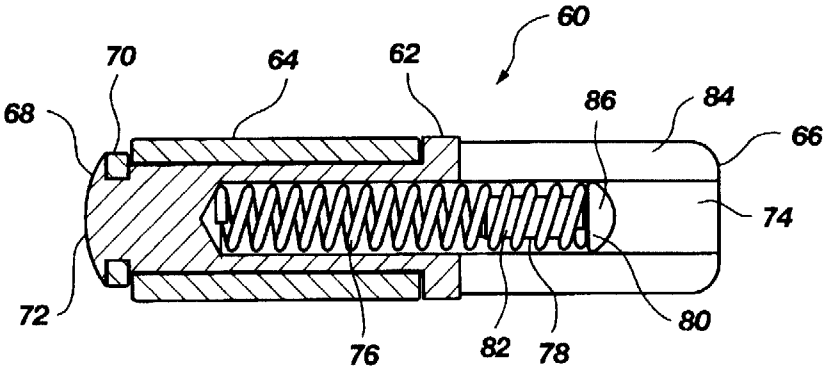
FIG. 6 is a cross-sectional view of a preferred embodiment of a foldable crank handle of the present invention, taken along line 6—6 of FIG. 3.

As shown in FIGS. 6 and 7, the handle 60 has a generally cylindrical body 62 and a rotatable sleeve 64. The body 62 has a proximal end 66 and a distal end 68, with the sleeve 64 being fitted over the distal end 68 and being free to rotate about the distal end 68. The sleeve 64 preferably has a knurled exterior surface for the user to grip. The handle 60 also has a washer 70 and a mushroomed end 72 formed in the distal end 68 of the body 62 to retain the sleeve 64 on the body 62.

A bore 74 is formed in the body 62 through the proximal end 66 and into the distal end 68, for receiving a spring 76 and a pin 78. The pin 78 has a rounded head 80 and a spring engaging portion 82. The pin 78 engages the spring 76 and compresses the spring 76 within the bore 74.

Figure 8:
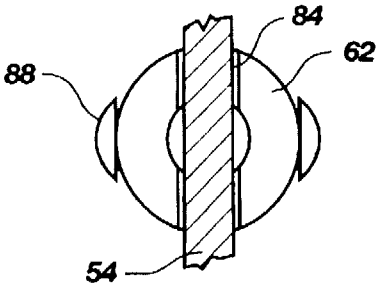
FIG. 8 is a cross-sectional view of a preferred embodiment of a foldable crank handle of the present invention, taken along line 8—8 of FIG. 5.

A slot 84 is formed in the proximal end 66 of the body 62 to receive the hanger portion 54 of the hanger 40, as shown in FIG. 8. As seen in FIGS. 6 and 7, a pivot hole 86 extends through the body 62 perpendicularly to the slot 84. A pivot pin 88 extends through the pivot hole 86 in the body 62 and movably attaches the handle 60 to the hanger portion 54 of hanger 40, as shown in FIG. 8. The handle 60 pivots about the pivot pin 88.

FIGS. 4 and 5 illustrate how the handle 60 indexes or locks in the crank position and the folded position, respectively. A folded index notch 90 and a crank index notch 92 are formed in the edge 94 of the hanger portion 54 of the hanger 40. The spring 76, compressed within the bore 74, forces the rounded head 80 of the pin 78 against the edge 94. In the folded position, the head 80 mates with the folded index notch 90. Likewise, in the crank position, the head 80 mates with the crank index notch 92. The force of the compressed spring 76 against the pin 78 keeps the head 80 in either notch 90 or 92 until the user pivots the handle 60, causing the head 80 to ride out of the notch 90 or 92 and along the edge 94. Without a user pivoting the handle 60, the force of the spring 76 maintains the handle 60 in either the crank or folded position.

To use the ice screw 10 of the present invention, a climber inserts the teeth 28 into a body of ice. The climber then pivots the handle 60 into the crank position and begins turning the shaft 20 into the ice. A continuous turning motion is preferred. When the shaft is sufficiently embedded in the ice, the climber pivots the handle 60 into the folded position. The climber may then secure himself to the ice by clipping on a carabiner into the eye 46 of the hanger 40.

The handle 60 allows a climber to continuously crank or turn the shaft 20 into the ice. Because the climber does not have to release and regrasp the hanger to rotate the shaft 20, less energy is expended in securing the ice screw in a body of ice. In addition, because the handle 60 uses the hanger 40 as a lever arm, a separate lever or crank arm is not needed. Therefore, the ice screw of the present invention eliminates unnecessary weight and components. Furthermore, because the handle 60 folds into the hanger 40, it does not continuously protrude and interfere with other critical equipment. Therefore, the ice screw of the present invention reduces unnecessary safety hazards.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. An ice screw device for use by climbers on a body of ice, said device comprising:

a shaft having screw threads;

a hanger attached to the shaft to cause the shaft to rotate when the hanger is moved, the hanger having an eye for receiving a clipped-on carabiner; and a crank handle attached to the hanger and pivotable between a folded position generally against the hanger, and a crank position where it may be grasped and moved to rotate the shaft.

2. The ice screw device of claim 1, wherein the handle includes means for causing the handle to index in the crank position.

3. The ice screw device of claim 1, wherein the handle includes means for causing the handle to index in the folded position.

4. The ice screw device of claim 1, wherein the hanger is formed with a recess in which the handle nests when in the folded position.

5. The ice screw device of claim 1, wherein the handle includes a rotatable sleeve for grasping by a user when moving the handle.

6. The ice screw device of claim 1, wherein the handle includes a biasing means for causing the handle to index in the crank position and the folded position when moved respectively thereto.

7. The ice screw device of claim 1, wherein the hanger is formed with an aperture through which the shaft passes for attaching the hanger to the shaft, said aperture having at least one generally flat side, and wherein said shaft includes at least one generally flat side for mating with the flat side of the aperture so that when the hanger is moved, the shaft is caused to rotate.

8. The ice screw device of claim 1, wherein the hanger handle attachment portion has an indexing edge, and wherein the handle comprises:

a handle body having a proximal portion and a distal portion, the body having a bore extending through the proximal portion and into the distal portion, and a slit formed in the proximal portion for receiving the indexing edge of the handle attachment portion of the hanger;

a spring disposed in the bore; and a pin disposed in the bore in engagement with the spring, and including a head which engages said indexing edge, the spring being disposed to force the head of the pin against the indexing edge.

9. The ice screw device of claim 8 wherein said indexing edge is formed with spaced apart indentations, into which the head of the pin is forced when the handle is moved into alignment therewith.

10. A method for securing a carabiner to a body of ice comprising the steps of:

(a) providing an ice screw having a shaft with screw threads and a hanger attached to the shaft, and a foldable crank handle attached to the hanger, the hanger having an eye for clipping a carabiner, the handle being pivotable between a folded position and a crank position where it may be grasped and moved to rotate the shaft;

(b) pivoting the handle of the ice screw to the crank position;

(c) inserting the end of the shaft of the ice screw into the body of ice;

(d) turning the handle of the ice screw to rotate the shaft until the shaft is at least partially screwed into the body of ice;

(e) pivoting the handle of the ice screw to the folded position; and (f) securing a carabiner to the hanger.

11. An apparatus for assisting climbers by securing a carabiner to a body of ice, said apparatus comprising:

a hollow shaft having external screw threads on a portion of the shaft, the shaft having a first end and a second end, the first end formed with teeth, the second end having a head having a rim with a diameter greater than the diameter of the shaft and at least one flat formed in the curve of the shaft;

a hanger attached to the shaft, the hanger having a recess on one side and an aperture through which the shaft passes for attaching the hanger to the shaft, the aperture having at least one flat formed in the curve of the aperture for mating with the flat formed in the shaft, the hanger including an eye for clipping a carabiner; and a foldable crank handle attached to the hanger for pivoting between a crank position and a folded position, the handle extending from the hanger in the crank position and nesting in the recess in the folded position.

* * * * *